US006244857B1

(12) United States Patent
VonDrasek et al.

(10) Patent No.: US 6,244,857 B1
(45) **Date of Patent: *Jun. 12, 2001**

(54) METHOD AND APPARATUS FOR OPTICAL FLAME CONTROL OF COMBUSTION BURNERS

(75) Inventors: William VonDrasek, Oak Forest; Louis C. Philippe, Oakbrook Terrace; Eric L. Duchateau, Clarendon Hills, all of IL (US)

(73) Assignee: American Air Liquide Inc., Walnut Creek, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/467,951

(22) Filed: Dec. 21, 1999

Related U.S. Application Data

(60) Division of application No. 08/859,393, filed on May 20, 1997, which is a continuation-in-part of application No. 08/797,020, filed on Feb. 7, 1997, now Pat. No. 5,829,962, which is a continuation-in-part of application No. 08/655,033, filed on May 29, 1996, now abandoned.

(51) Int. Cl.[7] ..... F23N 5/08

(52) U.S. Cl. ..... 431/79; 431/12; 431/13; 431/25

(58) Field of Search ..... 431/79, 12, 25, 431/13; 340/577, 578; 250/339.15, 554

(56) References Cited

U.S. PATENT DOCUMENTS

| | | | |
|---|---|---|---|
| 4,534,728 | 8/1985 | Vogels | 431/80 |
| 4,588,372 | 5/1986 | Torborg | 431/12 |
| 4,607,256 | 8/1986 | Henzel . | |
| 4,696,639 | 9/1987 | Bohan, Jr. . | |
| 4,756,684 | 7/1988 | Nishikawa et al. | 431/79 |
| 4,770,629 | 9/1988 | Bohan, Jr. | 431/80 |
| 4,934,926 | 6/1990 | Yamazaki et al. | 431/79 |
| 5,023,426 | 6/1991 | Prokosch et al. . | |

(List continued on next page.)

FOREIGN PATENT DOCUMENTS

| | | |
|---|---|---|
| 36 16 344 A1 | 11/1987 | (DE) . |
| 40 24 832 C1 | 8/1991 | (DE) . |
| 40 10 570 A1 | 10/1991 | (DE) . |
| 40 28 922 C2 | 7/1992 | (DE) . |
| 2 280 023 | 1/1995 | (GB) . |
| 60-129524 | 7/1985 | (JP) . |
| 7-91656 | 4/1995 | (JP) . |

OTHER PUBLICATIONS

UV–Detectors UVS 6, UVS 8, From Schroder, pp. 1–4, Dec. 1992.

*Primary Examiner*—Ira S. Lazarus
*Assistant Examiner*—Josiah C. Cocks
(74) *Attorney, Agent, or Firm*—Burns, Doane, Swecker and Mathis, LLP

(57) ABSTRACT

In accordance with the present invention, methods and apparatus to control the combustion of a burner are presented which overcome many of the problems of the prior art. One aspect of the invention comprises a burner control apparatus including a device for viewing light emitted by a flame from a burner, a device for optically transporting the viewed light into an optical processor, an optical processor for processing the optical spectrum into electrical signals, a signal processing for processing the electrical signals obtained from the optical spectrum, and a control device which accepts the electrical signals and produces an output acceptable to one or more oxidant or fuel flow control devices. The control device, which may be referred to as a "burner computer," functions to control the oxidant flow and/or the fuel flow to the burner. In a particularly preferred apparatus embodiment of the invention, a burner and the burner control apparatus are integrated into a single unit, which may be referred to as a "smart" burner.

13 Claims, 14 Drawing Sheets

U.S. PATENT DOCUMENTS

| | | | |
|---|---|---|---|
| 5,071,105 | 12/1991 | Donze et al. | 431/79 |
| 5,077,550 | 12/1991 | Cormier . | |
| 5,123,739 | 6/1992 | Takenouchi et al. . | |
| 5,126,721 | 6/1992 | Butcher et al. | 340/578 |
| 5,141,294 | 8/1992 | Van Zanten et al. . | |
| 5,191,220 | 3/1993 | Innes et al. . | |
| 5,222,713 | 6/1993 | Lawless et al. . | |
| 5,233,152 | 8/1993 | Prokosch et al. . | |
| 5,332,386 * | 7/1994 | Hosome et al. | 431/79 |
| 5,480,298 | 1/1996 | Brown | 431/79 |

* cited by examiner

METHOD AND APPARATUS FOR OPTICAL FLAME CONTROL OF COMBUSTION BURNERS

CROSS-REFERENCE TO RELATED APPLICATIONS

This application is a divisional of application Ser. No. 08/859,393, filed May 20, 1997, which is a continuation-in-part of application Ser. No. 08/797,020, filed Feb. 7, 1997, now U.S. Pat. No. 5,829,962 which is a continuation-in-part of application Ser. No. 08/655,033, filed May 29, 1996 now abandoned.

BACKGROUND OF THE INVENTION

1. Field of the Invention

The present invention relates generally to burner control, and more specifically to methods and apparatus for controlling combustion efficiency in burners.

2. Description of the Related Art

Numerous industrial processes such as glass or fritt melting, ferrous and nonferrous materials smelting, ladle preheating, billets reheating, waste incineration and vitrification, crude oil refining, petrochemical production, power plants, and the like use burners as the primary source of energy, or as an auxiliary source of energy. These burners possess one or more inlets for fossil fuels of high calorific value such as natural gas, liquefied petroleum gas, liquid hydrocarboneous fuel, and the like, which are combusted to produce heat. Some burners also comprise inlets for low calorific content gases or liquids that need to be incinerated. The fuels are burned in a combustion chamber where the energy that is released by the combustion is transferred to the furnace load. The combustion requires an oxidant, such as air, oxygen enriched air, or oxygen, and the oxidant is preferably preheated. The oxidant is also supplied by the burners.

Precise and reliable control of the combustion is very important for the efficiency and the safety of industrial processes, as will be understood by those skilled in the art.

For instance, it is well known that combusting a fuel with excess oxidant yields higher nitrogen oxides (NOx) emission rates, especially when the oxidant is preheated or when the oxidant is pure oxygen. On the other hand, incomplete combustion of a fuel generates carbon monoxide (CO). Both NOx and CO are very dangerous pollutants, and the emission of both gases is regulated by environmental authorities.

Combustion of a fuel with an uncontrolled excess amount of air can also lead to excessive fuel consumption and increase the production cost of the final product.

Safety of operation is an essential characteristic expected from all industrial combustion systems. Automated control of the presence of the flame in the combustion can be used to stop the flow of oxidant when the fuel flow is suddenly interrupted.

Commercially available UV flame detectors can be used to control the status (flame on or off) of a flame. However, this type of combustion control device does not give any information on the combustion mixture. It is impossible to know whether the burner is operated under fuel rich (excess of fuel, equivalence ratio greater than 1), fuel lean (excess of oxidant, equivalence ratio less than 1), or stoichiometric (exact amounts of fuel and oxidant to obtain complete combustion of the fuel, equivalence ratio equal to 1). UV flame detectors are typically self contained devices that are not always integrated in the burner design.

Endoscopes are also often used in the industry to visually inspect flames, and their interaction between the furnace load. They are generally complicated and expensive pieces of equipment that require careful maintenance. To be introduced into very high temperature furnaces, they require external cooling and flushing means:

high pressure compressed air and water are the most common cooling fluids. When compressed air is used, uncontrolled amounts of air are introduced in the furnace and may contribute to the formation of NOx. Water jackets are subject to corrosion when the furnace atmosphere contains condensable vapors.

Control of the combustion ratio at a burner can be performed by metering the flows of fuel and oxidant, and using valves (electrically or pneumatically driven) controlled by a programmable logic controller (PLC). The ratio of oxidant to fuel flow is predetermined using the chemical composition of the natural gas and of the oxidant. To be effective, the flow measurement must be very accurate and calibrated on a regular basis, which is not always the case, especially when the oxidant is air. This situation often leads the furnace operator to use a large excess of air to avoid the formation of CO. This feed-forward combustion control strategy does not account for the air intakes that naturally occur in industrial furnaces and bring unaccounted quantities of oxidant into the firebox, nor does this control scheme account for the variation of the air intakes caused by furnace pressure changes. Another drawback is that the response time of the feed-forward regulation loop is generally slow, and can not account for cyclic variations of oxidant supply pressure and composition that occur when the oxidant is impure oxygen, for example as produced by a vacuum swing adsorption unit or membrane separator. Yet another drawback of the feed-forward control of combustion ratio is that the PLC should be reprogrammed at every occurrence of a change in natural gas supply and composition.

Placing an in-situ oxygen sensor at the furnace exhaust can provide a feed-back control solution for global combustion ratio control. However, zirconia sensors for oxygen that are commercially available have limited lifetime and need to be replaced frequently. One difficulty met when using these sensors is a tendency to plug, especially when the exhaust gases contain volatile species, such as in a glass production furnace. When the furnace possesses more than one burner, a drawback of global combustion control is that it is not possible to know whether each individual burner is properly adjusted or not. This technique also has long response times due to the residence times of the furnace gases in the combustion chamber, which can exceed 30 seconds.

Continuous CO monitoring of the flue gas, for example in so-called post combustion control of an electric arc furnace, provides another means of controlling the combustion. It involves the use of a sophisticated exhaust gas sampling system, with separation of the particulate matter and of the water vapor. Although very efficient, these techniques are not always economically justified.

Other combustion control devices use acoustic control of flames. Most of these systems were developed for small combustion chambers in order to avoid extinction of flames, and are triggered by instabilities of flames.

The light emission observed from flame is one of the most characteristic features providing information on the chemical and physical processes taking place. Monitoring the flame light emission can be easily performed in well controlled environments typically found in laboratories. However, implementing flame light emission monitoring on industrial burners used on large furnaces is quite difficult in practice, resulting in a number of problems. First, optical access is necessary which requires positioning of a viewport in a strategic location with respect to the flame for collecting the flame light emission. Second, the plant environment is difficult because of excessive heat being produced by the furnace. Typical optical ports on a furnace can have temperatures in excess of 1000° C., thus necessitating the need for water cooled or high flow-rate gas cooled probes for use either in or near the furnace. Finally, these environments tend to be very dusty which is not favorable for the use of optical equipment except with special precautions, such as gas purging over the optical components.

While currently available systems have been able to achieve some degree of control over the combustion in a burner, there is a need for a fast response time control apparatus that avoids the previously described problems.

SUMMARY OF THE INVENTION

In accordance with the present invention, methods and apparatus to control or monitor the combustion of a burner are presented which overcome many of the problems of the prior art. One aspect of the invention comprises a burner control apparatus comprising means for viewing light emitted by a flame from a burner, means for optically transporting the viewed light into an optical processor, optical processor means for processing the optical spectrum into electrical signals, signal processing means for processing the electrical signals obtained from the optical spectrum, and control means which accept the electrical signals and produce an output acceptable to one or more oxidant or fuel flow control means. The control means may be referred to as a "burner computer," which functions to control the oxidant flow and/or the fuel flow to the burner. In a particularly preferred apparatus embodiment of the invention, a burner and the burner control apparatus are integrated into a single unit, which may be referred to as a "smart" burner.

Another aspect of the invention is a method of controlling one or several operating parameters of a burner, the method comprising the steps of:

(a) viewing light emitted by a flame from one or more optical ports on a burner;

(b) optically transporting the viewed light into an optical processor;

(c) optically processing the viewed light into usable light wavelengths and light beams;

(d) generating electrical signals with the usable wavelengths and beams; and (e) controlling the input of an oxidant and/or a fuel into the burner using the electrical signals, and/or activate an alarm.

Another aspect of the invention is the method of the above, where the operating parameters consist of one or a combination of stoichiometry, power, on-off status, fuel composition changes, oxidant composition changes, feedback on burner component condition, and emission from chemical species present in the burner flame.

Another aspect of the invention is for controlling the inputs of oxidant and /or fuel into a burner, the method comprising the steps of:

(a) selecting usable light wavelengths and light beams from one or more optical ports on the burner;

(b) operating the burner with various inputs of oxidant and/or fuel over a wide range of operating conditions;

(c) measuring the electric signals from the usable wavelengths and beams; and (d) establishing a mathematical function between the electrical signals and the inputs of oxidant and/or fuel.

Another aspect of the invention is the method of the above where the function is established using statistical modeling, neural networks, or physical modeling. Preferred methods of the invention are those wherein the light from the flame is viewed and optically transported using optical fibers.

According to yet another aspect of the invention, a process for controlling a fuel burner comprises the steps of monitoring burner flame emission, determining integrated intensity values for the flame emission, selecting specific integrated intensity values that vary with burner mixture composition changes, and adjusting the composition of the burner mixture based on the integrated intensity value.

Methods and apparatus according to the present invention are particularly useful for monitoring the flame emission on an industrial burner for use of an industrial process. The method is general enough to monitor flame emission in the ultraviolet, visible, or infrared spectral regions, allowing individual regions, multiple regions or single wavelengths to be monitored. Many of the problems of previous control mechanisms are avoided by adapting the burner housing with a window and/or an optical fiber positioned with respect to either the fuel injector, the oxidizer injector, or the refractory block, as will be seen further from the detailed description of the invention.

DESCRIPTION OF THE PREFERRED EMBODIMENTS

Figure 1:
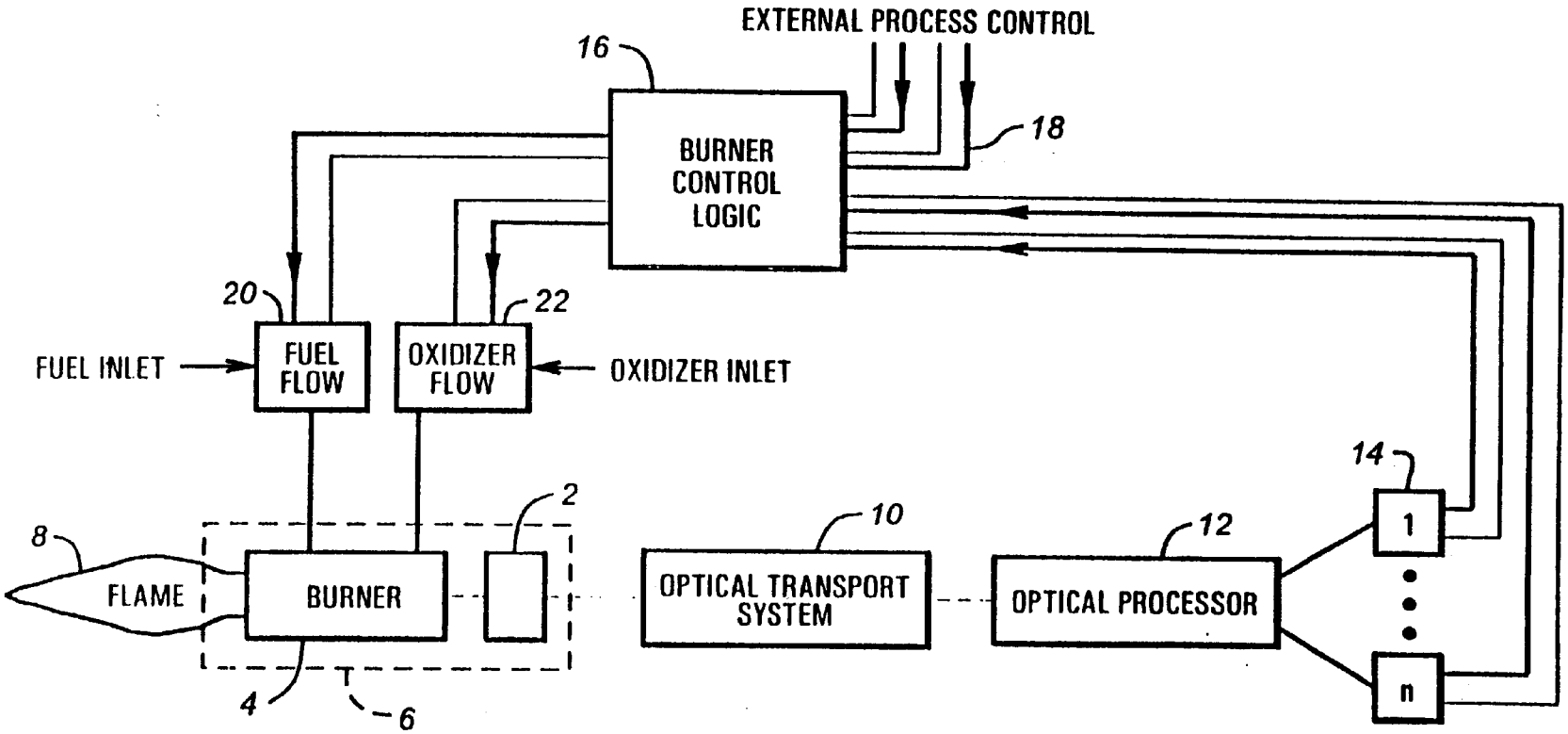
FIG. 1 represents a schematic block diagram of an apparatus of the invention.

A schematic block diagram of a preferred flame control apparatus of the invention is illustrated in FIG. 1. The apparatus comprises an optical coupling element 2 which functions to collect light emitted from a flame 8. Preferably, element 2 is an optical fiber. Optical coupling element 2 is preferably an integral part of a burner 4, the optical element and burner preferably housed in a single unit 6 (boxed area). After the light emission is collected it is transported by an optical transport system 10, which can either be one or more optical fibers or a plurality of lenses.

Optical processing is performed in an optical processor 12 to obtain characteristic information on specific spectral regions of the flame. For example, optical processor 12 may be an optical filter that allows only radiation of selected wavelengths to pass. This radiation may be monitored by either a photodiode or photomultiplier detector. Preferred optical processors of the apparatus of the invention employ one or more optical beam splitters, optical filters, and optical detectors. This allows one to simultaneously monitor multiple regions of the flame light emission spectrum.

Alternatively, a dispersion element could preferably be used in the optical processor to monitor complete spectral regions of the flame. Dispersion elements can be employed in a manner similar to an optical filter by tuning the dispersion element to a specific wavelength (or range of wavelengths) and monitoring the flame emission spectrum in a narrow spectral wavelength range, or by scanning the element (similar to a spectrometer) to collect a much larger spectral wavelength range. In this case a photodiode or photomultiplier that is sensitive to the wavelength range of interest can be used to convert the optical wavelength into an electrical signal that can be further processed. An array detector can also be used in conjunction with the dispersion element, allowing real-time detection of an entire spectral wavelength range of interest. Finally, all of the above mentioned detection methods can be used in combination with one another by using optical beam splitters or multiplexed optical fibers, with the appropriate number of multiple detection methods as described above.

After optical processing of the flame radiation, the electrical signal(s) obtained is (are) sent to one or more signal processors 14 which preferably comprise analog/digital converters, amplifiers, line drivers, or any other typical signal processing circuit device (FIG. 1). The electrical signal is then transmitted to a burner logic controller (BLC) 16 that determines operating conditions of burner 4. BLC 16 may accept other input signals from external process controls 18, such as a furnace supervision system (not shown). BLC 16 generates control signals that change the burner operating parameters (such as flow of fuel 20, and/or flow of oxidant 22) according to the information transmitted by signal processors 14. Suitable programmable logic controllers usable as BLCs are available from Siemens Co. Process control software, such as that available from Ocean Optics, Inc. may be employed to program the BLC.

This preferred combustion control apparatus can advantageously be implemented on every burner installed on an industrial furnace in order to more precisely control the combustion ratio of the whole furnace.

As previously noted, all of the components illustrated in FIG. 1 may be integrated into a so-called smart burner. In this aspect of the invention, the burner may be equipped with a fuel control valve and an oxidant control valve. Solid-state proportioning valves, such as those disclosed in U.S. Pat. No. 5,222,713, may be employed for controlling flow, but the use of the valves is not necessary to the present invention. The previous patent is incorporated herein by reference.

Figure 2:
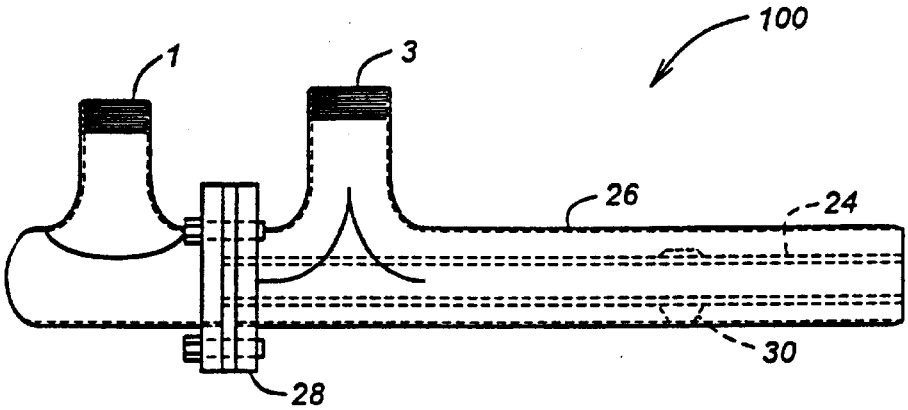
(PRIOR ART) FIG. 2
FIG. 2 represents a side elevation view of a prior art burner (reduced in scale) without any optical access.

FIG. 2 illustrates a prior art pipe-in-a-pipe burner 100 with inlets for fuel 1 and oxidant 3. In FIG. 2, burner 100 includes a fuel pipe 24 within an oxidant pipe 26. A flange and bolt arrangement 28 is typically employed. A support 30 is used to maintain the position of pipe 24 inside pipe 26, preferably concentric.

Figure 3:
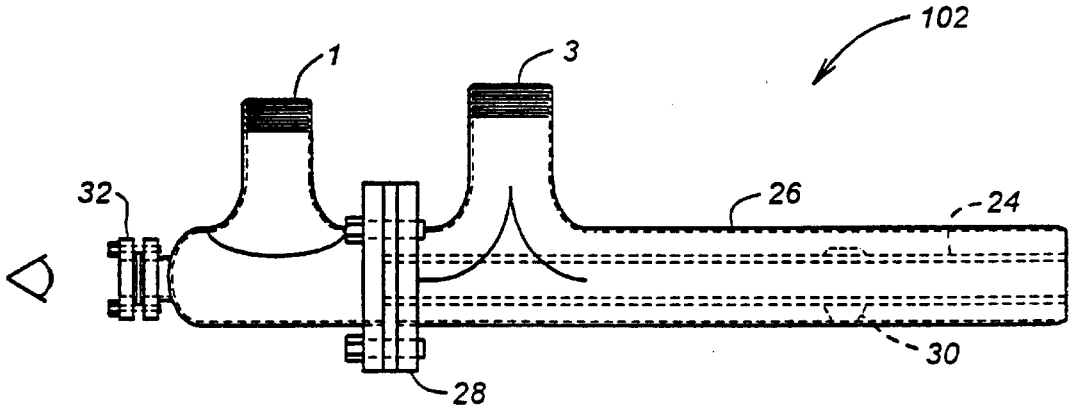
FIG. 3 represents the burner of FIG. 2 on which a window has been installed so that light emitted by the flame can be directed to an optical sensor.
Figure 4:
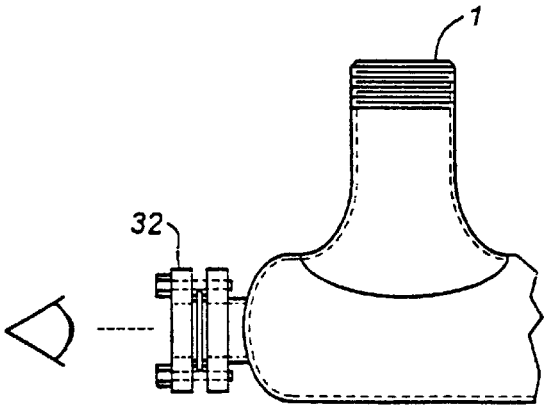
FIG. 4 represents a detailed view of the optical coupling of FIG. 3.

A schematic of a burner 102 modified to allow optical coupling with a window according to the present invention is illustrated in FIG. 3. In this embodiment, a window 32 is mounted on the rear of the burner such that optical access is provided through fuel injector pipe 24, as indicated in the detailed view of FIG. 4. The window material selected is preferably specific to the spectral region of interest. For example, if the ultraviolet region of the spectrum is of interest, then a quartz window would be applicable. However if infrared emission is of interest, then a sapphire window material would be suitable. An optical component, such as a combination of lenses, can be used to collect either the integrated emission along the length of the flame, or the emission from a selected point in the flame.

Figure 5:
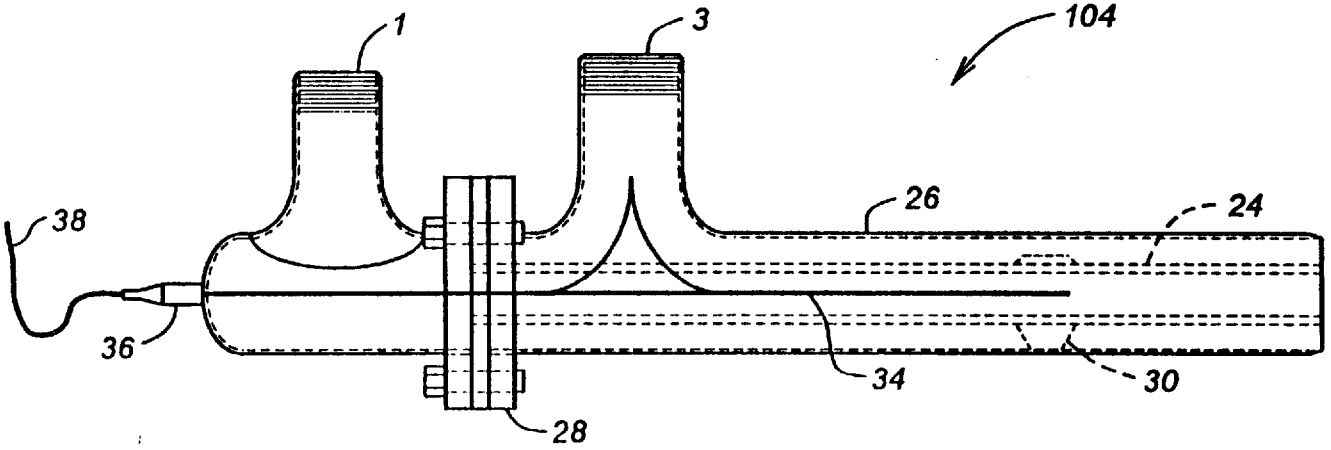
FIG. 5 represents the burner of FIG. 2 in which the optical coupling is an optical fiber having one extremity installed in a fuel injector.
Figure 6:
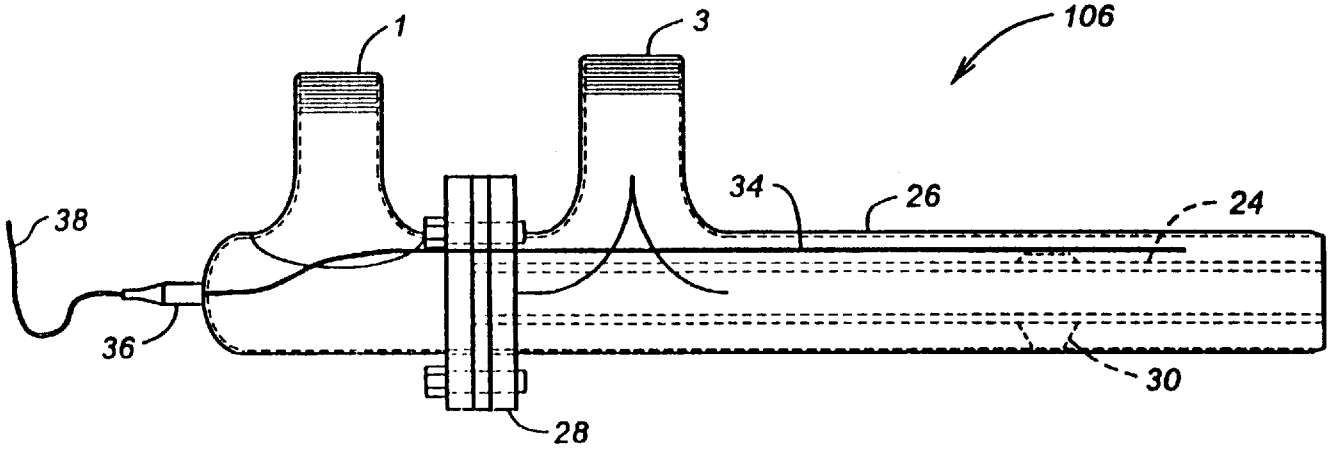
FIG. 6 represents the burner of FIG. 2 in which the optical coupling is an optical fiber having one extremity installed in an oxidant injector.

In the preferred embodiments illustrated in FIGS. 5 and 6, the flame emission is collected by an optical fiber 34 that is positioned in one of the burner injectors (fuel (FIG. 5) or oxidant (FIG. 6)). The choice of fiber material used depends on the spectral region of interest. Useable optical fibers preferably have core diameters varying from about 50 to about 1500 micrometers, more preferably from about 175 to about 225 micrometers, and are made from silica with a stainless steel cladding outer layer. A seal (not shown) provided between the fiber and burner housing can be a simple o-ring compression seal. Optical connector 36 connects optical fiber 34 to a second optical fiber 38 in each of these two exemplary embodiments. For the embodiments of FIGS. 5 and 6, the collected emission may also be integrated over the flame length or collected from a selected focused point in the flame for improved spectral resolution.

Figure 7B:
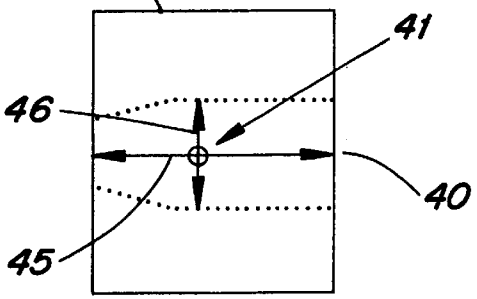
FIG. 7B represents a top plan view of the refractory block illustrated in FIG. 7A.
Figure 7A:
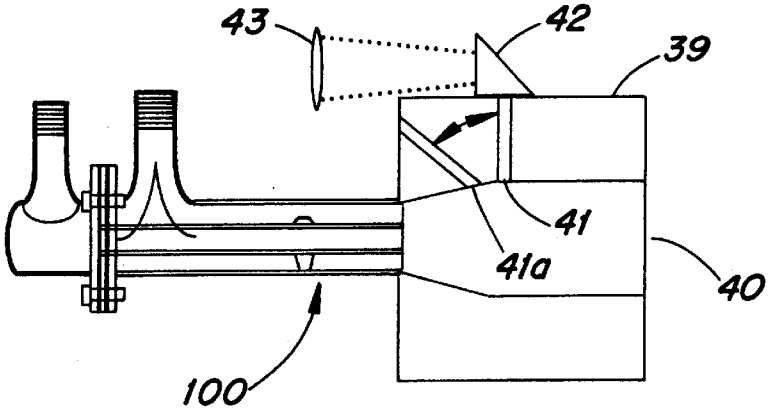
FIG. 7A represents a side elevational view of the burner of FIG. 2 according to another exemplary embodiment, illustrating a refractory block in which the optical coupling is a hole in the block to which the burner is attached.
Figure 8B:
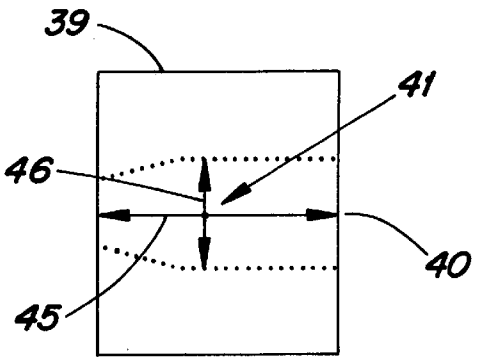
FIG. 8B represents a top plan view of the refractory block illustrated in FIG. 8A.
Figure 8A:
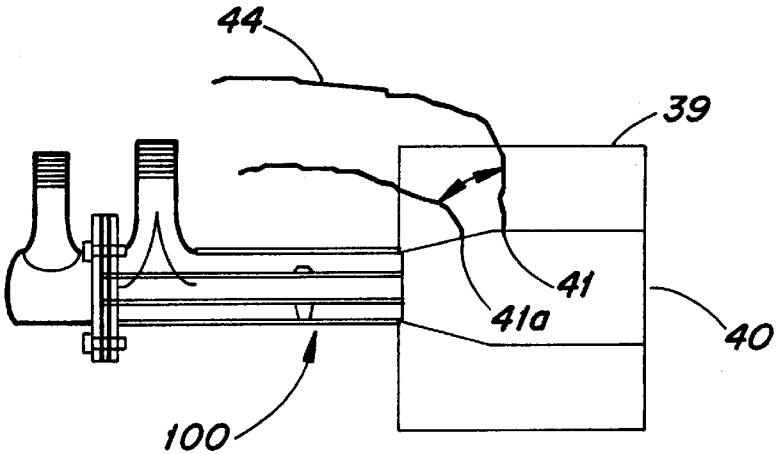
FIG. 8A represents a side elevational view of the burner of FIG. 2 according to another exemplary embodiment, illustrating a refractory block in which the optical coupling is an optical fiber having one extremity installed in the block to which the burner is attached.

In the preferred embodiments in FIGS. 7A, 7B, 8A, and 8B, the flame emission is collected through the refractory material 39. Burner 100 is attached to the refractory block 39 with the combustion gases exiting at opening 40. In FIGS. 7A and 7B, the flame radiation is collected through a hole 41 by a reflecting device 42, e.g., a prism or mirror, and is further transported to a detection system (not shown) by a lens or system of lenses 43 and/or fiber optic. The position of the hole 41 can be set anywhere within the area where gas is flowing, as indicated by arrows 45, 46, with the optimum position being at the location where maximum flame radiation is detected. This position can vary depending on the burner and refractory block design. In addition the angle of the view port 41 can be adjusted to any suitable position, as illustrated at 41*a*. Similarly, a fiber optic 44 can be directly inserted in to the refractory block as shown in FIG. 8. The location of the fiber 44 and/or the hole 41 an be set in any useable position through the top of the refraction block, sides, bottom, or back end near burner 100.

By adapting the burner housing with a window and/or optical fiber positioned with respect to the fuel injector and/or oxidant injector, the flame emission may be collected through the burner housing. By adapting the burner refractory block with an optical access port either by a combination of a hole and/or reflectors, and/or fiber optic, the flame emission may be collected through the refractory block. In addition, a combination of an adapted burner housing and an adapted refractory block can be used for collecting flame emission at multiple points. For either case the gas flow over the window 34 or optical fiber 44 provides cooling while also keeping the optical surface free of dust.

EXAMPLES OF OPTICAL PROCESSORS AND BURNER LOGIC CONTROL

As stated previously, the radiation emitted from a flame is one of the fundamental characteristics that provides information on the chemical and physical process involved. The capability to monitor this flame radiation can provide numerous applications useful for optimizing the furnace operation.

Here we cite a number of examples of how the flame emission can be used to control the combustion.

Example 1

Flame Stoichiometry Monitoring.

A specific region or regions of the spectrum may be monitored to provide information on the flame stoichiometry. For example, in the combustion of natural gas (NG) and oxygen, a strong continuum in the wavelength range of 350–700 nm is present with a maximum occurring near 650 nm. Part of this continuum is thought to result from chemiluminescence from the recombination reaction of CO+O=>$CO_2$. The strength (intensity) of this continuum has been observed to be related to whether the burner is operating near stoichiometric conditions. When operating under fuel-rich conditions the observed continuum intensity is weaker as compared to slightly fuel-lean or stoichiometric operating conditions.

Figure 9:
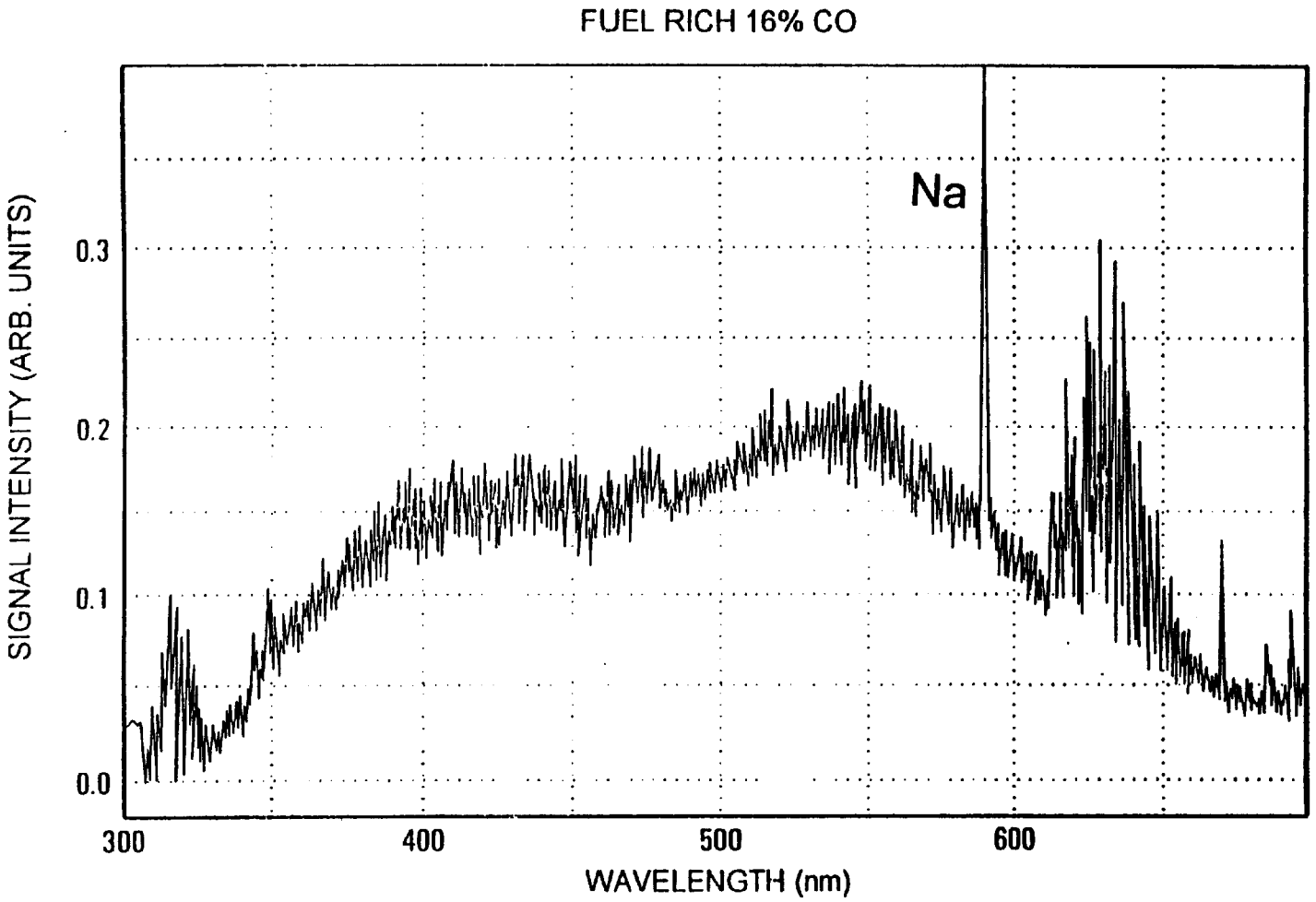
FIG. 9 represents the flame emission spectra of a flame operated under fuel lean conditions.
Figure 10:
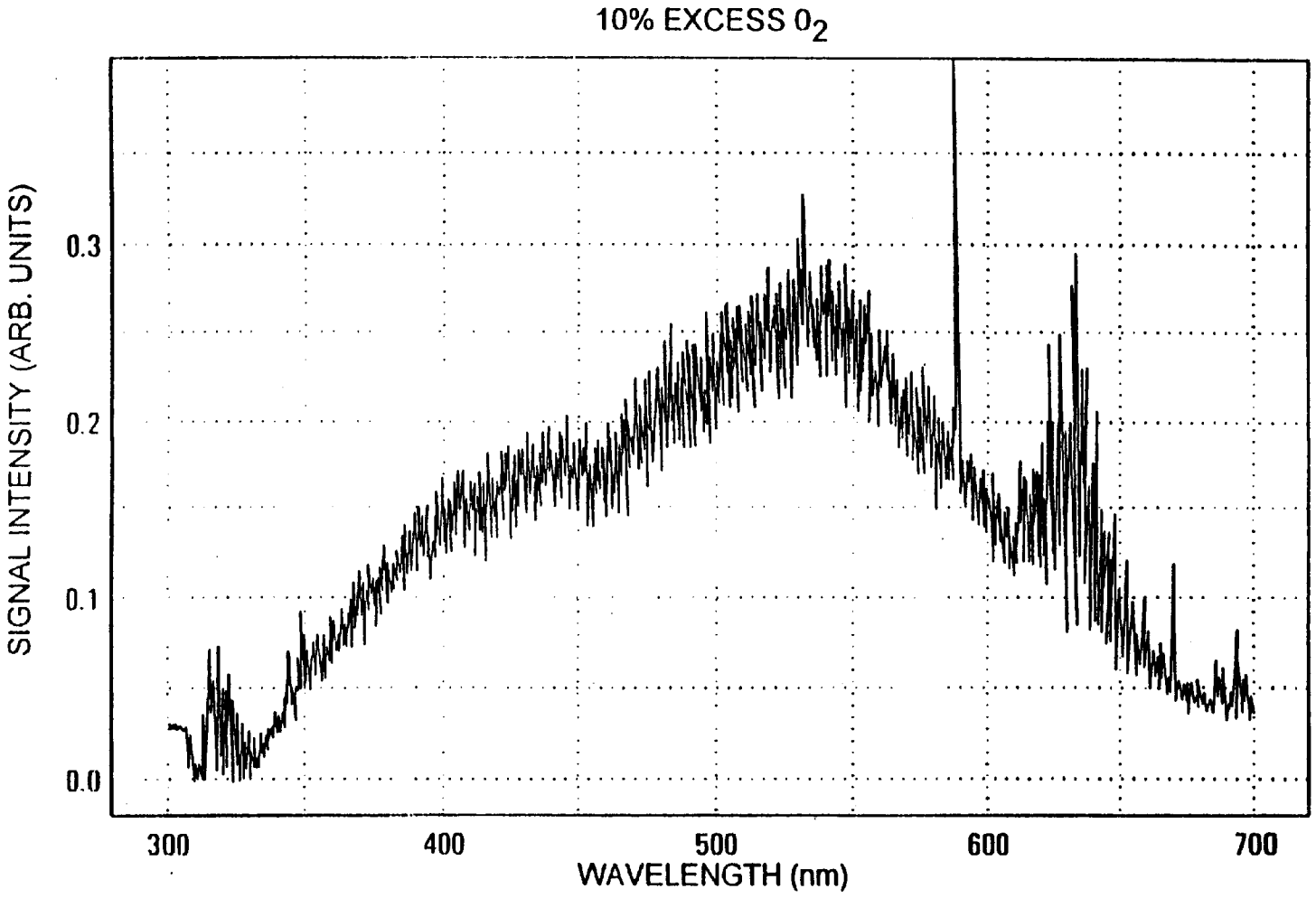
FIG. 10 represents the flame emission spectra of a flame operated under fuel rich conditions.

The effect of stoichiometry on the flame emission spectrum is shown in FIGS. 9 and 10. These spectra were obtained using a fiber optic and lens positioned externally to the burner. Flame emission was collected through the natural gas (NG) injector and window mounted on the burner as shown in FIG. 3. The fiber optic was coupled to a 0.5 micrometer Acton monochromator with a Hamamatsu 1P28A photomultiplier (PMT) detector. The emission spectra was obtained by scanning the monochromator over a specified wavelength region, in this case from 300 to 700 nm. The signal from the PMT was then processed in a EG&G 4402 Boxcar averager. FIG. 9 represents the visible emission of a flame generated by an oxygen-natural gas burner similar to the one illustrated in FIG. 2, when there is an excess of fuel (fuel rich). FIG. 10 represents the visible emission spectrum of the same flame with flow rates of natural gas and oxygen such that there is an excess of oxygen of 10% (fuel lean). At 530 nm, there is a weaker signal when the combustion mixture is fuel rich (FIG. 9) than when the mixture is fuel lean (FIG. 10).

The signal obtained can then be compared to a calibration curve relating signal intensity to firing stoichiometry. Depending on the desired operating conditions, control action on the fuel and oxidant flows can be performed to adjust the burner fuel and/or oxidant flows to optimize the flame. For example, if a reducing atmosphere is desirable one would want to adjust the fuel and/or oxidizer such that the observed continuum intensity decreases. Again using the apparatus illustrated in FIG. 1, every burner used in the process could be individually monitored.

Toward the infrared region of the spectrum, flame emission related to soot could also be monitored. Since soot is a particle, it behaves as a black body, with broadband emission, as opposed to gaseous species emission which occurs in specific regions (lines). In certain applications a sooty flame which increases the luminosity may be desirable. On the other hand, soot formation in a flame can be an indication of incomplete combustion of the fuel, which requires an adjustment of the combustion ratio. Monitoring of the appropriate spectral region will provide information for the process control action required.

Example 1.1

Experiments were conducted using a burner and optical coupling as illustrated in FIG. 3. The optical coupling device was attached to a standard burner known under the trade designation ALGLASS available from Air Liquide America Corp., Houston, Tex. The burner had an output of 1.2 MMBtu/hr (using oxygen 99% pure as oxidant) allowing flame emission spectra to be collected through the natural gas (NG) injector. Ultraviolet and visible flame radiation covering a spectral rage of 300–700 nm were collected for different combustion stoichiometries defined in terms of equivalence ratio (Φ), wherein:

$$\Phi = \frac{\text{actual fuel/oxidant (vol/vol)}}{\text{stoichiometric fuel/oxidant (vol/vol)}}$$

For stoichiometric operating conditions, Φ=1, whereas for fuel-lean conditions Φ<1, and for fuel-rich conditions Φ>1. Results showing the variation of the flame emission spectra for different values of Φ are graphically illustrated in FIG. 11. The spectra were obtained using a fiber optic and lens positioned externally to the bumer. Flame emission was collected through the natural gas (NG) injector and window mounted on the burner as shown in FIG. 3. The fiber optic was coupled to a 0.5 meter Acton monochromator with a Hamamatsu 1P28A photomultiplier (PMT) detector. The emission spectra shown in FIG. 11 was obtained by scanning the monochromator over a specified wavelength region, in this case from 300 to 700 nm. The signal from the PMT was then processed in a EG&G 4402 Boxcar averager.

Figure 11:
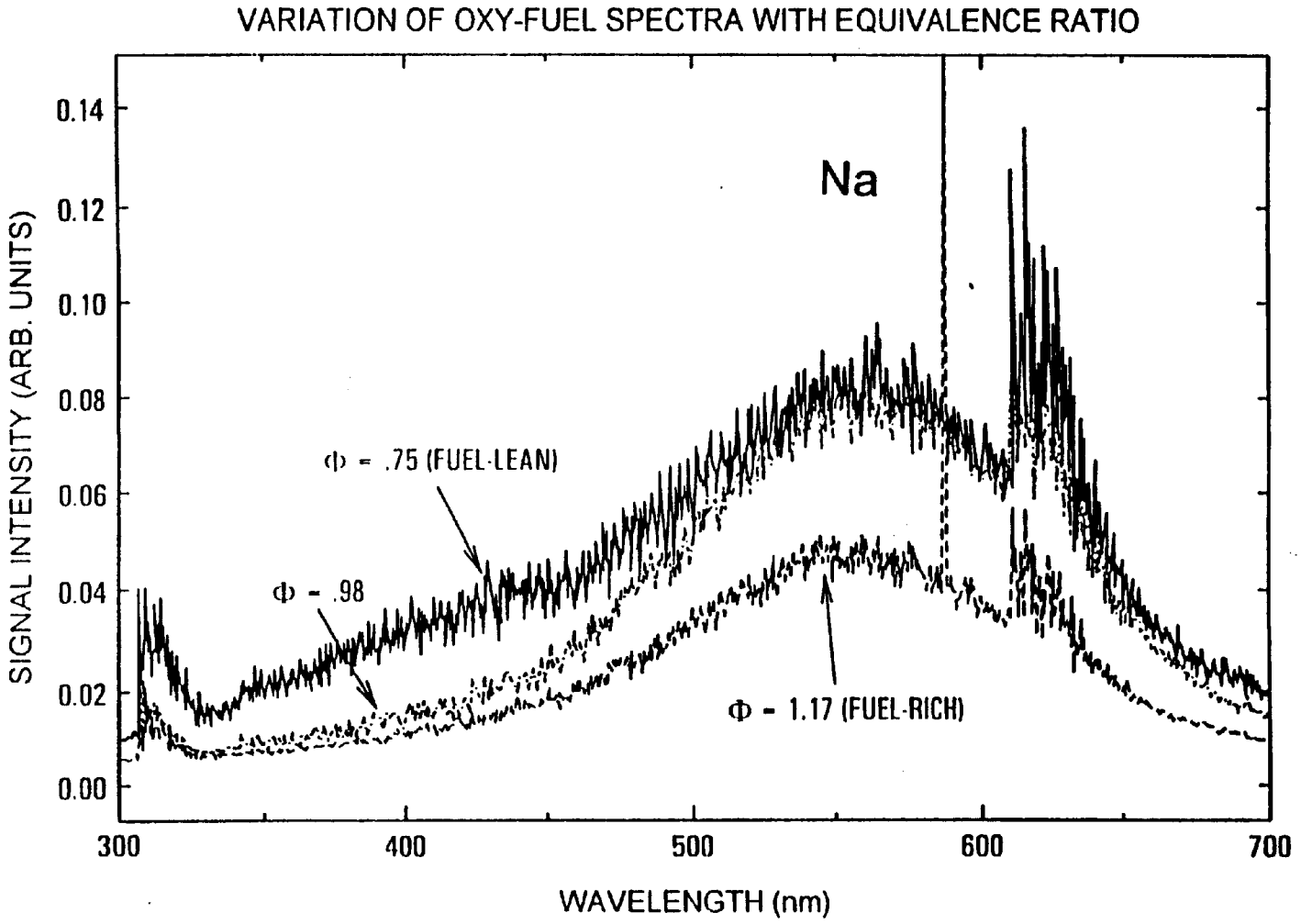
FIG. 11 represents the flame emission spectra obtained for three different burner operating conditions.
Figure 12:
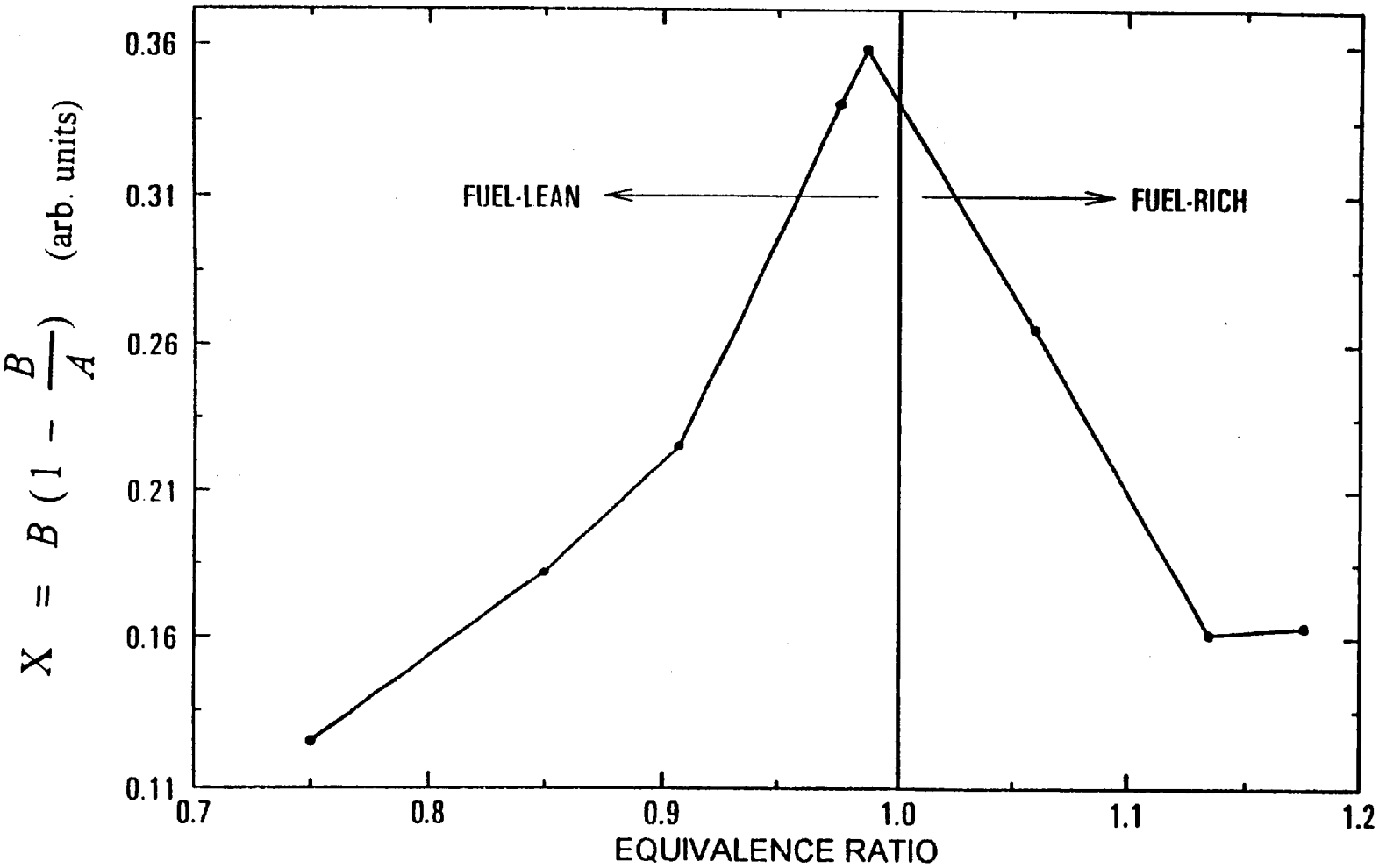
FIG. 12 is a graphical representation of the relationship between emission spectra and stoichiometry.

From FIG. 11, a number of distinct differences relative to the stoichiometric spectra ($\Phi$=0.98) were seen. First, for $\Phi$=0.75 the continuum below 550 nm and the OH (hydroxyl radical) band were noticeably stronger, but above 550 nm the distinction was not so clear when compared to the $\Phi$=0.98 spectra. Second, for $\Phi$=1.17 the continuum below 425 nm was only slightly different from the $\Phi$=0.98 case, but a significant difference was seen near 550 nm. These results suggested that the spectral region near 400 nm and 550 nm could be used for relating the observed flame emission to the stoichiometry. Both regions are necessary to account for fuel-lean and fuel-rich operating conditions. By manipulating the data, a relationship between these spectral regions and the stoichiometry was developed, $$X = B\left(1 - \frac{B}{A}\right)$$

where B is the average signal from 540–560 nm and A is the average signal from 390–410 nm. A graphical representation of X for different $\Phi$ values is shown in FIG. 12. In this case the burner power was constant at 1.2 MMBtu/hr while the $O_2$ flow was adjusted to change stoichiometry, hence changing the value of $\Phi$. From FIG. 12, X has a maximum at $\Phi$ slightly on the fuel-lean side of stoichiometric conditions with a sharp decrease on either side of the maximum as fuel-lean or fuel-rich operating conditions were approached. Applying this expression into an algorithm in the BLC or similar control device, the burner can be maintained at near stoichiometric conditions by adjusting fuel and oxidizer flows to achieve a maximum value of X.

Example 1.2

The intensity of the emitted flame radiation detected depends on the wavelength region that is being observed. This wavelength dependence results from chemiluminescence of excited state chemical species, continuum emission from atom molecule reactions, and continuum emission from the presence of particles either being entrained or formed in the flame. These effects can be classified as purely chemical, i.e., the observed flame radiation is only a result of the chemical process taking place with no external influences. In addition to the pure chemical effects, other factors can influence the spectrum intensity such as characteristics of how the fuel and oxidizer are mixed, burner, background contributions, entraimnent of chemical species into the flame, furnace, and the method used to collect the radiation, e.g. optical system. Therefore the flame radiation intensity observed in a process can be expressed as a multivariable function:

$$I_\lambda = \int\int\int f(B, S, P, OD, OC, F, O, \rho)dV \quad (1)$$

where $I_\lambda$ is the observed intensity at wavelength $\lambda$ integrated over the sample volume. This intensity is a function of the burner (B) characteristics, combustion stoichiometry (S), burner power (P), and optical detector (OD), optical collection system (OC), fuel (F), oxidizer (O), and process ($\rho$) disturbances.

In addition these variables can also be time dependent. For example, in turbulent diffusion flames the mixing between fuel and oxidizer at a fixed location in the flame will vary with time, i.e., the local stoichiometry (S) and power (P) change randomly within some range. The variable $\rho$ may also be considered time dependent, e.g., when particle entrainment into the flame is not constant. A more general expression for the observed intensity becomes $$I_\lambda(t) = \int\int\int f(B, S(t), P(t), OC, OD, F, O, \rho(t))dV \quad (2)$$

In general the variables B, OD, OC, F, O can be considered time invariant. Of course, burner or collection optic degradation can occur, which can result in $I_\lambda$ changing. However, these effects can usually be considered long term, i.e., the time scale for $I_\lambda$ to change from changes in B, OD, and OC is much greater than that for the variables S, P, and $\rho$. The variables F (fuel) and O(oxidizer) may change from day-to-day because of the source being changed. In this case, the sensitivity of $I_\lambda$ to changing F or O would need to be determined.

Because most industrial processes are stochastic in nature, an average value of $I_\lambda$ is more practical to work with. Here the time-averaged value of $I_\lambda(t)$, denoted by $\langle I_\lambda(t)\rangle$, is defined as the integral on time over a time interval T, divided by the time interval:

$$\langle I_\lambda(t)\rangle = \frac{1}{T}\int_t^{t+T} I_\lambda(t)\,dt \quad (3)$$

where the magnitude of the time interval T needs only to be long enough to average out the fluctuations.

For practical applications such as process control of a burner, the variables OC, OD, B, F, and O are generally constant, e.g., the burner configuration, collection optics, and optical detector are not changed once the system is in place. As stated above, these variables may also be considered time invariant. Then Eq. (2) reduces to the following:

$$\langle I_\lambda(t)\rangle = \int\int\int f(S(t), P(t))dV \quad (4)$$

where $\rho(t)$ was assumed negligible. Furthermore the total integrated intensity observed over a wavelength range can be expressed as $$\Gamma_i = \int_{\lambda_{1,i}}^{\lambda_{2,i}} \langle I_\lambda(t)\rangle\,d\lambda \quad (5)$$

$$i = 1, 2, 3\ldots$$

where the subscript i is an index for referencing a $\Gamma_i$ value to a specific spectral region from $\lambda_{1,i}$ to $\lambda_{2,i}$. Therefore single or multiple values of $\Gamma_i$ values can be used in the burner monitoring system. For the case where multiple $\Gamma_i$ values are used, individual regions and/or combinations of linear and/or nonlinear terms may be applied in the monitoring system.

Since $\langle I_\lambda(t)\rangle$ is a function of both stoichiometry and power, f(S,P), then it follows that $\Gamma_i = f_i(S,P)$. The change in the integrated intensity can then be related to the changes in S and P by the relation $$d\Gamma_i = \left(\frac{\partial \Gamma_i}{\partial S}\right)_P dS + \left(\frac{\partial \Gamma_i}{\partial P}\right)_S dP$$

$$i = 1, 2, 3\ldots$$

A solution to the above equation for a specific spectral region can be obtained once the partial derivatives are determined. Evaluation of the partial derivatives can be obtained by performing a calibration over a range of operating conditions at constant P and then at constant S. This will give the relationships $\Gamma_P$=f(S) and $\Gamma_S$=f (P) that can be used to evaluate Eq. (6), where the subscript denotes the constant variable. This calibration can then be used for controlling and monitoring the burner stoichiometry and power. The following example illustrates how these partial derivatives can be obtained from experimental measurements.

Example 1.3

In this example the flame emission is monitored using the configuration shown in FIG. 3, i.e., the flame emission was observed through the NG injector. Flame radiation was transported by a 12 ft long 100 $\mu$m diameter fiber optic attached at the rear of the burner. At the other end the fiber was attached to an Ocean Optics model PC1000 PC spectrometer board with a spectral range of 290–800 nm. The variables OC, OD, O, F, B, and ρ were held constant and only P and S were changed. The influence of the furnace, which is lumped into ρ, can be neglected provided the flame emission is observed below 400 nm. At longer wavelengths background radiation from the furnace walls would have to be included. In the spectral region between 300 and 400 nm the changes in stoichiometry and power can be observed by either monitoring the OH band observed between 290 and 325 nm or part of the continuum, e.g., between 340–360 nm.

Figure 14:
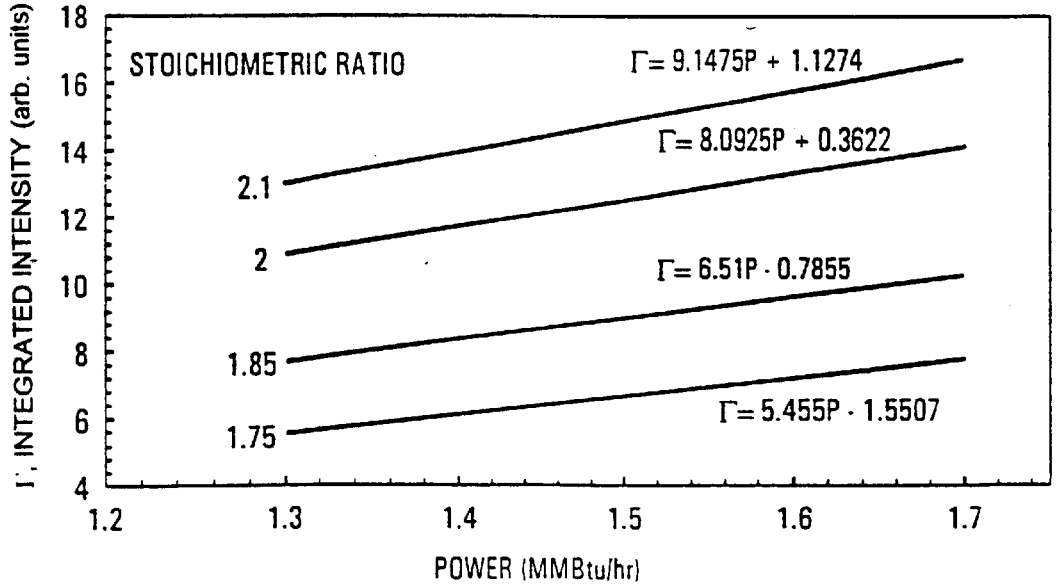
FIG. 14 is a graphical representation of the relationship between emission intensity for a selected spectral region and burner power for different stoichiometries.

In this example the fuel was natural gas and the oxidizer was oxygen; therefore, the theoretical stoichiometric ratio was 2, where the stoichiometric ratio is defined as (moles of oxygen/moles of fuel). Here $CH_4+2O_2 \rightarrow 2H_2O+CO_2$. FIG. 14 shows the integrated OH intensity ($\lambda_1$=290 nm and $\lambda_2$=325 nm in Eq. (5)) at different stoichiometries and burner powers.

For further reference the value of Γ will refer to $$\Gamma = \int_{290\text{nm}}^{325\text{nm}} \langle I_\lambda(t) \rangle \, d\lambda$$

which represents the integrated OH emission intensity observed by the detection system.

Figure 13:
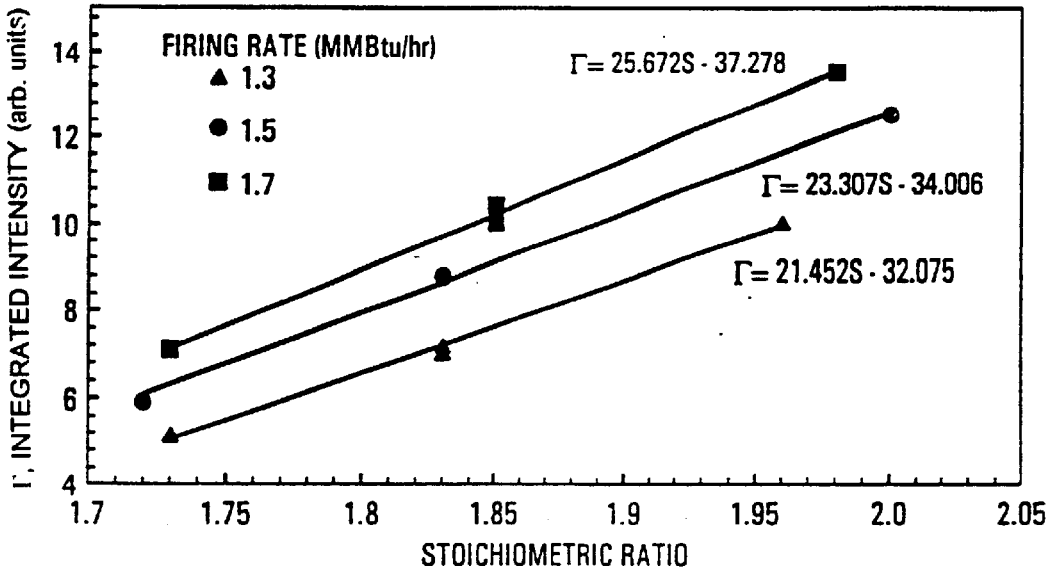
FIG. 13 is a graphical representation of the relationship between emission intensity for a selected spectral region and stoichiometry for different burner powers.
Figure 15:
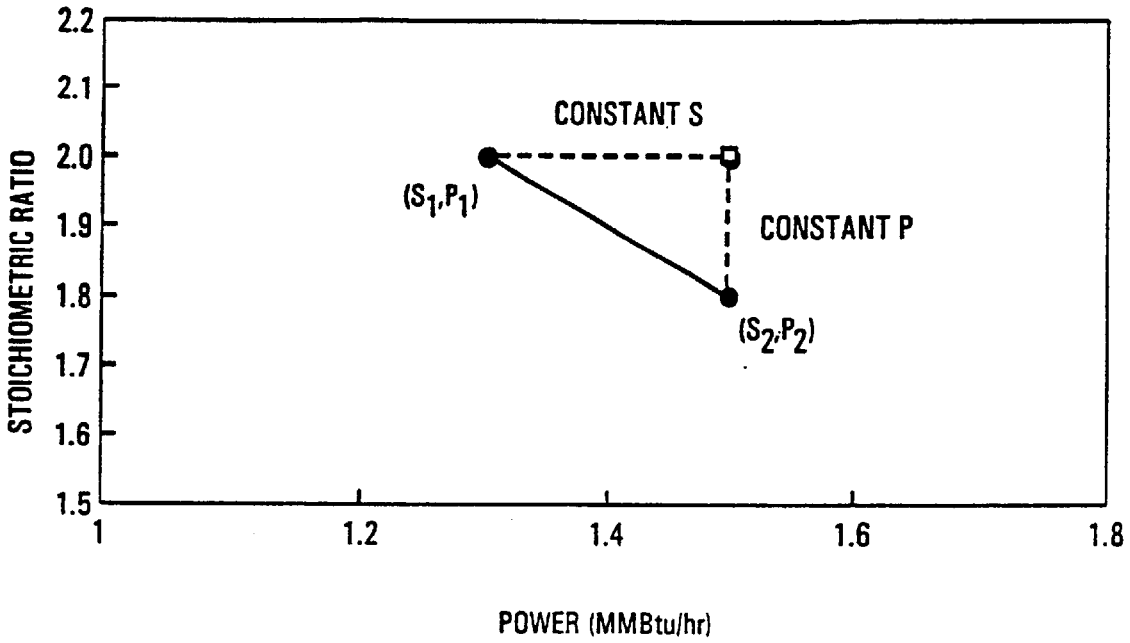
FIG. 15 is a graphical representation illustrating the integration along a path of constant stoichiometry and power.

For a given power level a linear fit can be obtained over the stoichiometric range tested. Similarly, for fixed stoichiometries a linear fit can be obtained over the power range tested, as shown in FIG. 14. The linear regressions for both P and S result in a family of curves. Changes in S and P can be determined by solving Eq. (6), first along paths of constant P, then along a path of constant S, as illustrated in FIG. 15, where the partial derivatives are evaluated from the linear calibration functions shown in FIGS. 13 and 14.

Figure 16:
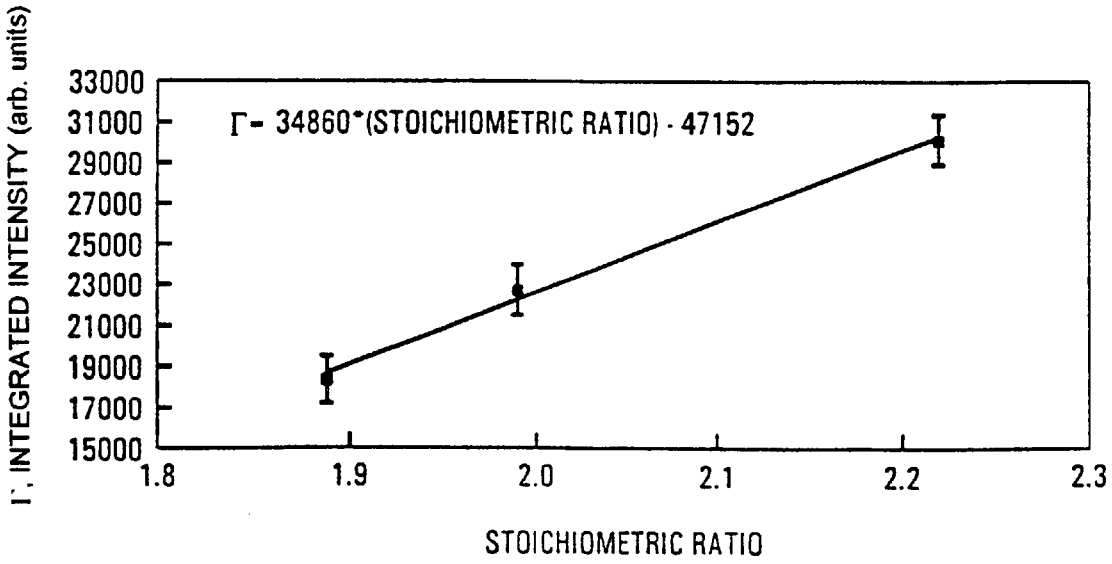
FIG. 16 is a graphical representation for a calibration of the integrated emission intensity for a selected spectral region and stoichiometry for a 1.5 MMBtu/hr burner.

The following illustrates how the above method can be used for controlling and/or monitoring stoichiometry in a burner at constant power. In this example, the same configuration as discussed above is used and all variables are fixed except the stoichiometry (S). Thus the power (P) is fixed. Prior to the test a calibration was performed to determine $\Gamma_P$=f(S) by monitoring the integrated OH emission intensity at different stoichiometric ratios and a constant power of 1.5 MMBtu/hr. In this case the power was fixed and determined by knowing the fuel composition and flow rate. With the fuel variables held constant, the $O_2$ flow was varied to allow measurement of OH emission at different stoichiometries. The calibration provides a good linear fit over the stoichiometric ratio range of 1.88–2.22 tested, as shown in FIG. 16. In FIG. 16 the error bars represent the standard deviation for 180 samples at each stoichiometric condition.

The calibration provides a linear function of the form $$\Gamma_\rho = AS+B \tag{7}$$

where A and B are constants and can be determined from the calibration.

Figure 17:
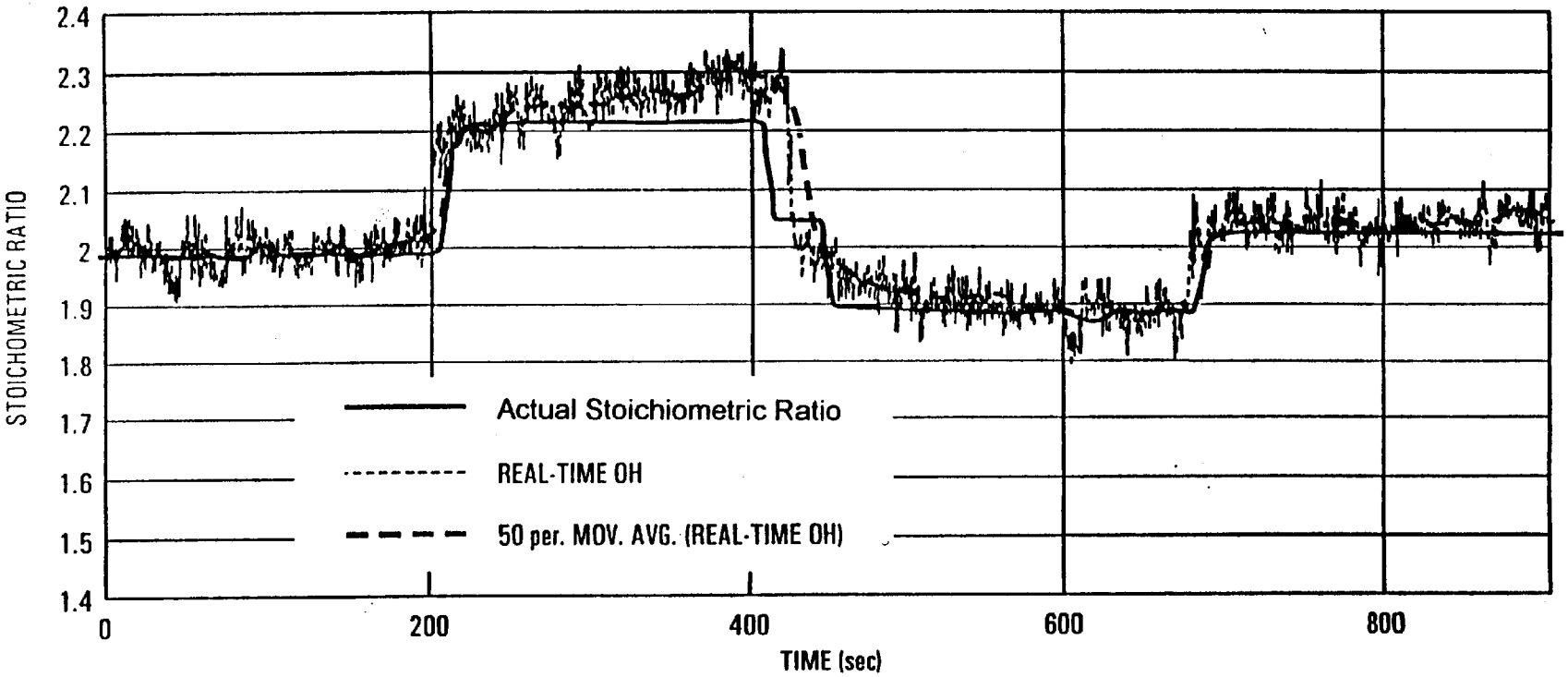
FIG. 17 is a graphical representation for real-time monitoring of the integrated emission intensity converted to stoichiometry using the graphical representation of FIG. 14 for a selected spectral region, compared with stoichiometric ratios based on the fuel and oxidant flow rate.

Incorporating Eq. (7) into a computer algorithm for real-time processing of the integrated OH signal allows the stoichiometry to be monitored at a high sampling rate as shown in FIG. 17. In FIG. 17 the integrated intensity is sampled at 3 Hz. The sampling rate is only exemplary, and is limited only by the computer hardware used. Higher sampling rates may also be used. The dashed line shows the result of a 50 point moving average that is applied to remove temporal fluctuations. These results show good agreement with the stoichiometric ratios based on flow rate measurements of both NG and oxygen, shown as the solid line in FIG. 17.

To adapt this methodology for process control applications of a burner, e.g., programming Eq.(7) into the BLC or similar process control device, requires knowledge of the power. The power can be determined by knowing the flow rate and composition of the fuel. An alternative method for determining the power is by optical means that will be discussed in example 2.2. Measurements of the fuel flow rate by devices such as mass flow meters and orifice plates can be input into the BLC or similar device. An algorithm in the BLC can interpret this information and choose the appropriate function in the form of equation (7) for determining the stoichiometry. As stated above, a family of curves over a range of stoichiometry exist for each power level. The BLC can then select the appropriate curve to use based on the fuel flow rate information, or interpolate between curves if the exact expression for a particular power is not in the program data base.

Example 2

Monitoring the Burner Firing Rate.

This application is similar to Example 1, in that the emission intensity is related to the firing rate of the burner. In this case a calibration is performed to relate the observed signal at some selected wavelength to the burner firing rate. Once this information is known, control of the firing rate can be adjusted accordingly by programming the BLC or similar process control device.

Example 2.1

As discussed in Example 1.2, the power and stoichiometry are coupled. Therefore the methodology illustrated in Example 1.2 requires that either the stoichiometry or the power be know to determine the other. The power can be determined by using a calibration curve, e.g., FIG. 14, at constant stoichiometry. Here a linear function of the form $$\Gamma_S = AP+B \tag{8}$$

where A and B are constants determined from the calibration. Incorporating Eq. (8) into a computer algorithm, e.g., in the BLC or similar control system, the power can be both monitored and controlled.

Example 2.2

Figure 18:
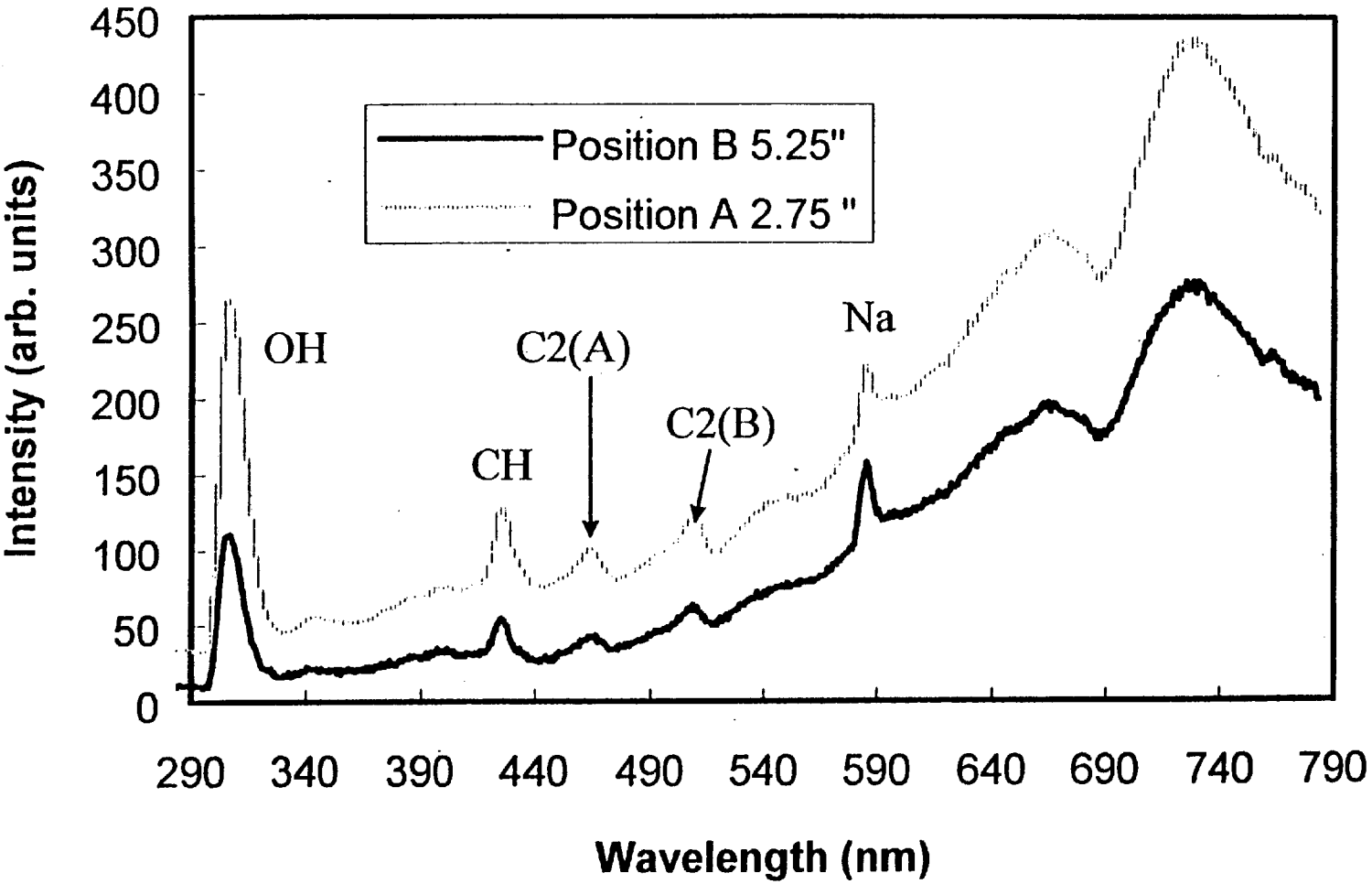
FIG. 18 is a graphical representation of an emission spectra obtained using the optical configuration shown in FIGS. 7A and 7B.

The above example illustrates a method for monitoring and controlling the burner power, but with the condition that the stoichiometry is known. In this example a methodology for determining the burner power independent of stoichiometry is described. This example also illustrates the use of Eq. (5) of Example 1.2 for the case of multiple $\Gamma_i$ values. In examples 2.1 and 1.2, only a single $\Gamma$ value was monitored for determining the burner stoichiometry or power. A single $\Gamma$ value is used because the optical access shown in FIGS. 3, 5, or 6 allows only monitoring either OH omission or part of the emission continuum, and both are functions of stoichiometry and power. To increase the number of variables to monitor from the burner the flame emission is collected perpendicular or diagonally across the flame as shown in FIGS. 7–8. Using the configuration as shown in FIG. 7A, the flame radiation was transported by a 12 ft long 100 $\mu$m diameter fiber optic. At the other end the fiber was attached to an Ocean Optics model PC1000 PC spectrometer board with a spectral range of 290–800 nm. A typical spectra obtained with this configuration is shown in FIG. 18, for 1.5 MMBtu/hr NG and oxygen flame. From the spectrum in FIG. 18, combustion intermediate radicals OH, CH, and two bands related to $C_2$, labeled C2(A) and C2(B) on FIG. 18, are detected. Therefore this spectrum has four unique peaks that are related to the chemical and physical processes taken place in the flame.

Using a computer algorithm for real-time processing, the integrated area of the four peaks with background removed were simultaneously collected at a frequency of 5 Hz. This sampling rate is merely exemplary, and is only limited by the computer hardware and software used. Higher or lower sampling rates may also be used. Collecting the integrated area of the peaks provides four values of $\Gamma_i$, thus i=4 in Eq. (5). With the $\Gamma_i$ values a statistical model was constructed using multivariable regression that minimized the effect of stoichiometry changes for predicting the burner power. The resulting expression from the statistical model that predicts the power for this example has the following form $$\text{Power}=\beta_a\Gamma_1^2+\beta_b\Gamma_2^2+\beta_c\Gamma_1\Gamma_2+\beta_c\Gamma_1\Gamma_4+\beta_f\Gamma_2\Gamma_3+\beta_g\Gamma_2\Gamma_4+\beta_h\Gamma_1+\beta_i\Gamma_2+\beta_j\Gamma_3+\beta_k\Gamma_4+\beta_1$$

where $\Gamma_1$,$\Gamma_2$,$\Gamma_3$, and $\Gamma_4$ represent the integrated intensity for the OH, CH, $C_2$(A), and $C_2$(B) peaks on FIG. 18 and the $\beta$ values are constants. To determine the $\beta$ constants, real-time values of $\Gamma_i$ were collected at different burner powers and stoichiometry ratios. A reduced model, i.e., less terms can also be used, if the resulting fit is satisfactory for use on a particular process. Higher order terms may also be added to the model, but for this example the improvement is not significant.

Figure 19:
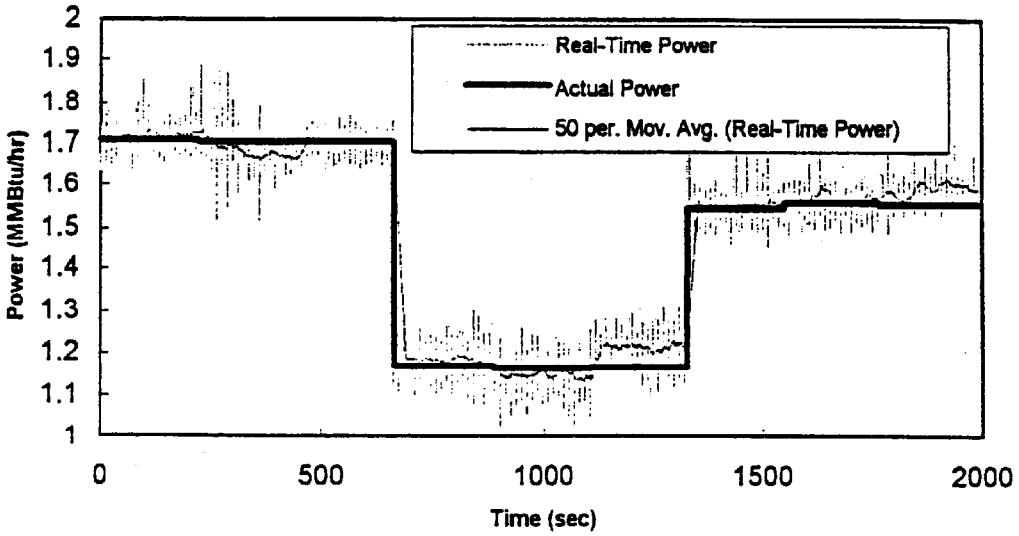
FIG. 19 is a graphical representation for real-time monitoring of the integrated emission intensity converted to represent burner power compared with power measurements based on the fuel flow rate and the calorific value of the fuel.
Figure 20:
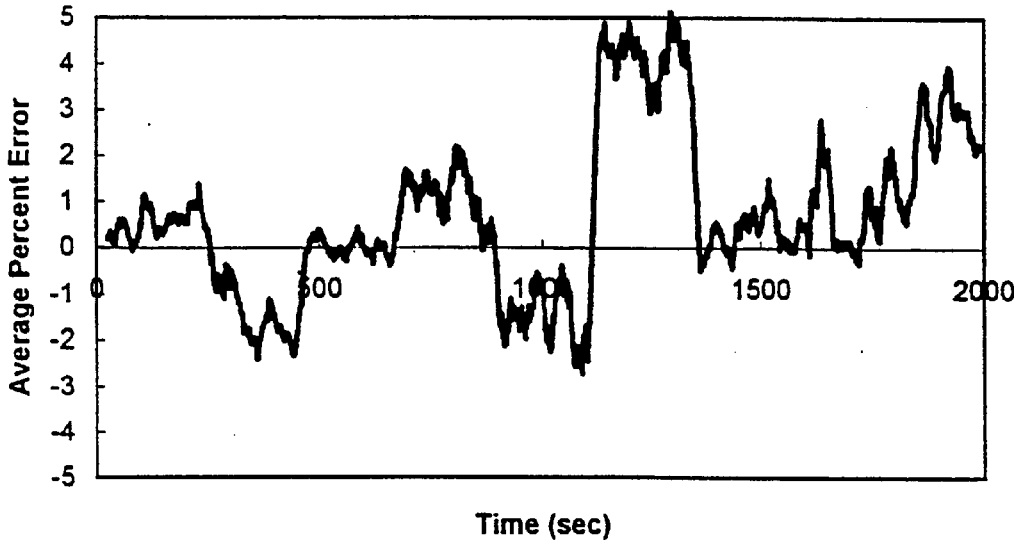
FIG. 20 is a graphical representation showing the average percent error of the results in FIG. 19 from the predicted burner power.

Results from the model are shown in FIG. 19 comparing the predicted and actual burner power. At each power level in this example the stoichiometric ratio was adjusted between 1.95 and 2.15 with the exception of the 1.55 MMBtu/hr range where the stoichiometry varied between 2 and 2.15. Overall the model predicts the power within±5%.

A combination of the method discussed in examples 1.2 and 2.2 can be applied to provide complete control of the burners stoichiometry and firing rate. In this case the BLC would process input signals from two separate optical measurement locations. One signal would pertain to determination of burner power by means similar to the above example. Once the power is determined this information would be used for determining the stoichiometry by means discussed in Example 1.2. Output signals from the BLC could then adjust the appropriate operating conditions of the burner, e.g., oxidant or fuel flow rates.

Alternative methodologies for predicting the power from selected optical signals can be applied, such as neural networks (NN). In this case the multiple $\Gamma_i$ values would be the input processing elements of the NN. The NN would then be trained to produce the desired output signal. Complete control of the burner stoichiometry and power can be achieved by constructing a NN with the appropriate input information. The design and use of neural networks is described in Nelson, M. and Illingworth, W., "*A Practical Guide to Neural Nets*," Addison-Wesley, 1991.

Example 3

Safety Alarm.

Detection of the flame radiation can be used to identify the presence or absence of the flame. If the signal level drops below a set-point level an alarm can be triggered, indicating a problem with the burner. For this case a region in the ultraviolet, for example below 300 nanometers (nm), would be best to discriminate against visible and infrared emission from the furnace walls. Typically furnaces use UV flame monitors for detection of the flame. This application would provide not only a secondary backup detection system, but could also alert the operator of other problems. For example, conditions which can severely damage the burner, such as material build-up causing the flame to deflect, or a piece of refractory blocking the burner exit, can be detected. For these cases, the emission characteristics could change, setting off an alarm indicating a potential problem. In general, commercial UV flame monitors are presently used only to indicate the presence or absence of flame radiation.

Example 4

Monitoring Chemical Tracers.

In this application chemical tracers may be added to fuel and/or the oxidant streams directly, or entrained into the flame from the surrounding environment. For example, the introduction of particles into the flame, such as titanium dioxide, can be used to monitor the temperature by using a two-color optical pyrometer technique. In this case the temperature is being determined from the radiation of light emitted by the particle. Two or more wavelengths are required to be monitored since the particle's emissivity is often unknown.

Example 5

Environmental Combustion Monitoring.

The detection of pollutants such as Nox or Sox may be directly or indirectly monitored. However, it is difficult to quantify these pollutants because the observed signal is both temperature and concentration dependent, but gross changes in the observed signal levels can be monitored. For example, NOx could be directly monitored in the ultraviolet spectra region near 226 nm. Alternatively, NOx may be indirectly monitored from the OH (hydroxyl radical) emission signal. A strong OH emission signal has been discovered to indicate a corresponding increase in measured NOx (provided $N_2$ is present) levels from the exhaust stack of a pilot furnace. In either case the method provides a means of determining gross changes in pollutant formation occurring for an individual burner.

The CO level in a high temperature process can be monitored by the addition of an oxidant, where the oxidant can be air, oxygen enriched air, or pure oxygen. When CO is burned the reaction $CO+O\text{->}CO_2$ occurs, as discussed in example 1, resulting in the emission of a continuum of radiation in the wavelength region from below 300 to beyond 600 nm. The observed radiation intensity emitted by the reaction is related to the amount of CO present. The CO concentration may be measured and/or used as an alarm. The numerous examples described above using the inventive burner-mounted optical flame control apparatus illustrates the variety of applications where such a device can be found useful for industrial application. Certainly this list of applications is not all inclusive and additional applications could be thought of, depending on the process requirements.

Example 6

Identifying Fuel and/or Oxidant Composition Change.

For the industrial user, fuel and/or oxidant compositions can change, depending on the source from the supplier. The change in fuel and/or oxidant composition can effect both the stoichiometry and power of the burner. Generally, changes in fuel and/or oxidant composition are detected by global changes in the process, such as changes in temperature and/or flue gas composition. In either case, the time to observe these changes in the process can be very long and can depend on the volume of the process and the degree the fuel and/or oxidant composition changed. Once a parameter (e.g., temperature or fuel gas composition) has been identified to have changed, the appropriate adjustments can be performed on the burner, such as changes in fuel and oxidant flow rates.

According to the present invention, a change in fuel composition can be identified by the change in the flame emission. Alternatively, on-line gas analysis can be performed on the fuel and oxidant using gas chromatography or mass spectrometry. These latter two methods have the disadvantage of requiring frequent calibrations and maintenance. By monitoring the flame emission using any of the configurations shown in FIGS. 3–8B, changes in the fuel composition can be detected at the point of use. Point of use monitoring eliminates the time to observe global changes, e.g., temperature and/or flue gas composition, in the process due to fuel composition changes.

Figure 21:
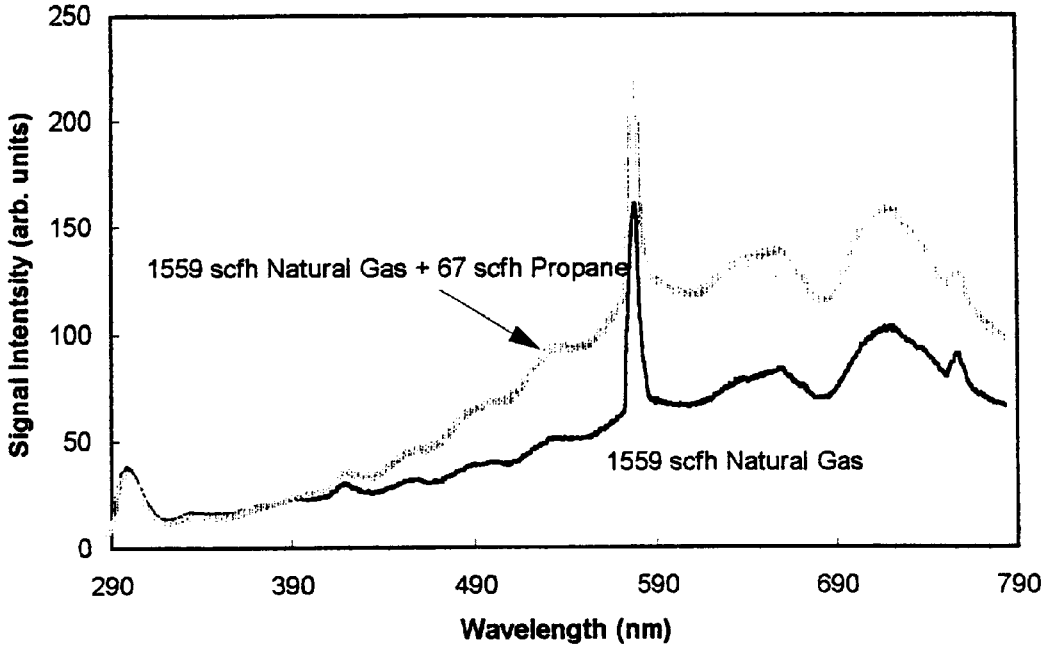
FIG. 21 is a graphical representation of an emission spectra for changing fuel composition obtained using the apparatus illustrated in FIG. 3.

In the example illustrated in FIG. 21, optical access was obtained using the apparatus illustrated in FIG. 3. The second example, illustrated in FIG. 22, used the apparatus illustrated in FIG. 7. In both examples, the flame radiation was transported by a 12 ft. long, 100 $\mu$m diameter fiber optic leading to an Ocean Optic model PC1000 PC spectrometer board with a spectral range of 290–800 nm. In these examples natural gas (NG) and oxygen were the standard fuel and oxidant. For changes in the fuel composition, propane was added to the NG stream with flow rates of both NG and oxidant held constant.

Results from monitoring the flame radiation through the NG injector (using the apparatus illustrated in FIG. 3) are illustrated in FIG. 21. FIG. 21 illustrates that the addition of 67 scfh propane resulted in increased emissions in the visible region (390–790 nm) of the spectrum due to the formation of soot, which increases flame luminosity. Accompanying the soot formation, an increase in CO is also observed. The CO would, however, be detected in the flue gas after some residence time.

Figure 22:
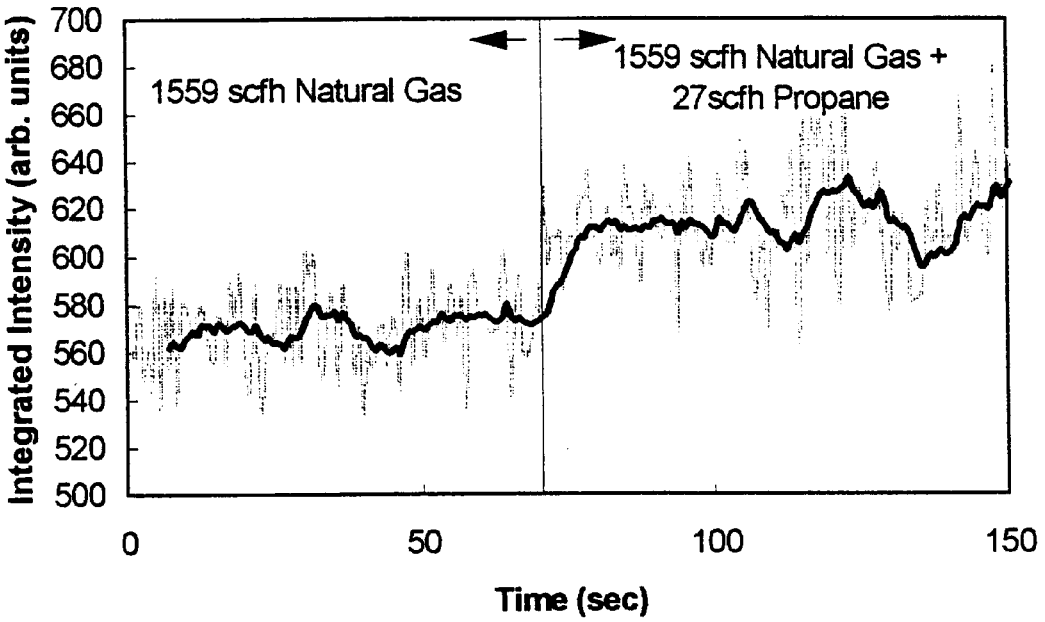
FIG. 22 is a graphical representation for real-time monitoring of the integrated emission intensity for changing fuel composition obtained using the apparatus illustrated in FIG. 7A.

Results from monitoring the flame radiation through the burner block (using the apparatus illustrated in FIG. 7) are illustrated in FIG. 22. FIG. 22 illustrates only the integrated area from the CH peak (see FIG. 18). With the addition of propane at about 70 seconds, the signal level of the CH peak increases along with an increase in CO as discussed above with respect to FIG. 21.

Using any of the apparatus illustrated in FIGS. 3–8B for process control, the detection of changes in the emission spectrum may be correlated to changes in the fuel and/or oxidant. These changes are detected, transported to the process control system, e.g., the BLC, which can then make appropriate adjustments to the burner. Typically these adjustments involve changing the oxidant and/or fuel flow rate, although other process parameters can also be adjusted as will be readily apparent to one of ordinary skill in the art.

Various modifications to the described preferred embodiments will be envisioned by those skilled in the art; however, the particular embodiments herein should not be construed as limiting the scope of the appended claims.

What is claimed is:

1. Apparatus for fuel burner control comprising:

(a) means for viewing light emitted by flame from a burner;

(b) means for optically transporting the viewed light emitted by a flame from said burner into an optical processor means;

(c) optical processor means for processing the optical spectrum into electrical signals;

(d) signal processing means for processing said electrical signals obtained from the optical spectrum; and (e) control means which accept the electrical signals and produce an output acceptable to one or more oxidant or fuel flow control means.

2. Apparatus in accordance with claim 1 wherein said means for viewing is selected from the group consisting of a window on the burner, a window on the burner refractory block, and an optical fiber.

3. Apparatus in accordance with claim 1 wherein said means for transporting comprises optical elements selected from the group consisting of a plurality of lenses, an optical fiber, optical beam splitters, and optical filters.

4. Apparatus in accordance with claim 1 wherein said optical processor means is selected from the group consisting of optical detectors, photomultipliers, photodiodes, and array detectors.

5. Apparatus in accordance with claim 1 wherein said signal processing means is selected from the group consisting of analog/digital converters, amplifiers, line drivers, and combinations thereof.

6. Apparatus in accordance with claim 1 wherein said control means comprises a programmable logic controller.

7. An integrated fuel burner and stoichiometry control apparatus comprising:

(a) the fuel burner control apparatus of claim 1; and (b) a burner housing having at least one fuel injector and at least one oxidant injector, wherein said means for viewing light comprises an optical fiber positioned within at least one of the fuel or oxidant injectors in a position suitable for viewing said flame.

8. Apparatus in accordance with claim 7 wherein said means for optically transporting the viewed light comprises one or more optical fibers, beam splitters, and optical filters.

9. An integrated fuel burner and stoichiometry control apparatus comprising:

(a) the fuel burner control apparatus of claim 1; and (b) a burner housing having at least one fuel injector and at least one oxidant injector, wherein said means for viewing light comprises a window positioned on the burner housing in a position suitable for viewing said flame.

10. Apparatus in accordance with claim 9 wherein said means for optically transporting the viewed light comprises one or more lenses.

11. A method of controlling the combustion ratio of a burner, the method comprising the steps of:

(a) viewing light emitted by a flame from a burner;

(b) optically transporting the viewed light into an optical processor;

(c) optically processing the viewed light into usable light wavelengths and light beams;

(d) generating electrical signals with the usable wavelengths and beams; and (e) controlling the input of an oxidant and/or a fuel into the burner using the electrical signals.

12. Method in accordance with claim 11 wherein the light from the flame is viewed by a first optical fiber and transported to an optical processor using a second optical fiber.

13. A method of operating a burner comprising the steps of:

(a) monitoring flame emission through a fiber optic attached to a spectrometer;

(b) holding variables OC, OD, O, F, B, and E constant while independently varying the variables P and S to obtain a family of curves for the intensity value Γ of OH emission at constant P while varying S, and at constant S while varying P;

(c) solving the equation:

$$d\Gamma = \left(\frac{\partial \Gamma}{\partial S}\right)_P dS + \left(\frac{\partial \Gamma}{\partial P}\right)_S dP$$

by integrating first at constant P, then at constant S, to obtain the intensity Γ of OH emission of the flame; and (d) adjusting a fuel control means, an oxidizer control means, or both, based on the intensity Γ value.

* * * * *